US005212840A

United States Patent [19]

Caldwell

[11] Patent Number: 5,212,840

[45] Date of Patent: May 25, 1993

[54] STABILIZING TOILET SEAT GUIDE

[76] Inventor: Leroy Caldwell, 110 Big Oak Cir. S., Stockbridge, Ga. 30281

[21] Appl. No.: 765,998

[22] Filed: Sep. 26, 1991

[51] Int. Cl.[5] ..... A47K 13/04

[52] U.S. Cl. ..... 4/237; 4/248

[58] Field of Search ..... 4/237, 248, 661

[56] References Cited

U.S. PATENT DOCUMENTS

| | | | |
|---|---|---|---|
| 1,051,508 | 1/1913 | Miller | 4/248 X |
| 1,129,010 | 2/1915 | Pfau | 4/248 |
| 1,334,137 | 3/1920 | Delany | 4/248 X |
| 1,628,277 | 5/1927 | Schacht | 4/248 |
| 2,104,714 | 1/1938 | Moore | 4/248 X |
| 3,646,620 | 3/1972 | McCawley | 4/237 |
| 4,747,167 | 5/1988 | Adams | 4/661 X |

OTHER PUBLICATIONS

Taylor Gifts catalogue, #7643 Wiggle Stop TM set.

*Primary Examiner*—Henry J. Recla
*Assistant Examiner*—Robert M. Fetsuga
*Attorney, Agent, or Firm*—Needle & Rosenberg

[57] ABSTRACT

A device for stabilizing a toilet seat in its desired position atop a toilet bowl, comprising at least one restraint connectable to the bottom of the toilet seat for preventing lateral movement of the toilet seat relative to the toilet bowl, wherein the restraint extends downward into the toilet bowl so as to rest immediately adjacent to an upper inside rim of the toilet bowl when the toilet seat is in its lowered position. In a preferred embodiment the device includes a tapered configuration on the restraint to guide the toilet seat onto the toilet bowl, and an edge portion which is substantially parallel to the inside edge of the toilet bowl when the seat is in the lowered position, which serves to stabilize the toilet seat by preventing lateral movement.

13 Claims, 1 Drawing Sheet

STABILIZING TOILET SEAT GUIDE

BACKGROUND OF THE INVENTION

Virtually every home, restaurant and place of business utilizes a toilet. With the increased emphasis on providing equal access to the handicapped and growing number of the elderly, many bathrooms are equipped with rails and other devices to aid the individual while using the toilet. such devices increase the safety of using the toilets and thus benefit the handicapped, elderly and the population in general.

Overlooked in all the toilet safety devices is the stability of the toilet seat when the seat is lowered and the individual is sitting on the seat. Often the supporting device used on virtually all toilet seats will slip, which can result in a damaging fall to the individual. This danger is especially true for individuals of limited mobility, who often first arrive on the seat with great momentum or at an unusual angle.

As a result of the instability of toilet seats, the hinge which connects the seat to the toilet bowl often loosens. This problem is compounded by the fact that most bowls are porcelain or ceramic and cannot be adequately secured or repaired. Thus, the industry has gone to very expensive hinges to combat the loosening of the hinge resulting from seat instability.

Thus, there is a great need for a device which is cost effective and can guide and stabilize the seat when in the lowered position. Especially beneficial would be a device which can replace the device currently utilized to separate the toilet seat from the toilet bowl but yet provide improved guiding and stabilization. The present invention satisfies this need and provides related advantages.

SUMMARY OF THE INVENTION

This invention provides a device for stabilizing a toilet seat in its desired position atop a toilet bowl, comprising at least one restraining means connectable to the bottom of the toilet seat for preventing lateral movement of the toilet seat relative to the toilet bowl, wherein the restraining means extends downward into the toilet bowl so as to rest immediately adjacent to an upper inside rim of the toilet bowl when the toilet seat is in its lowered position. In a preferred embodiment the device includes a tapered configuration on the restraining means to guide the toilet seat onto the toilet bowl.

DETAILED DESCRIPTION OF THE INVENTION

This invention provides a device for stabilizing a toilet seat in its desired position atop a toilet bowl. The device comprises at least one restraining means connectable to the bottom of the toilet seat for preventing lateral movement of the toilet seat relative to the toilet bowl, wherein the restraining means extends downward into the toilet bowl so as to rest immediately adjacent to an upper inside rim of the toilet bowl when the toilet seat is in its lowered position.

Figure 1A:
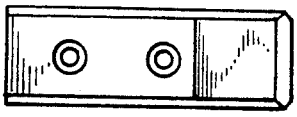
FIG. 1 shows one embodiment of the toilet seat guiding and stability device from the top view (FIG. 1A), right side view (FIG. 1D), left side view (FIG. 1B), front view (FIG. 1C), and bottom view (FIG. 1E).
Figure 1B:
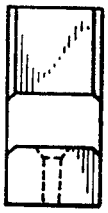
Figure 1C:
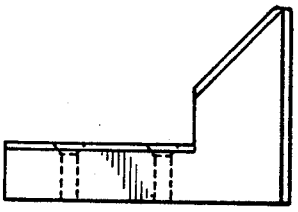
Figure 1D:
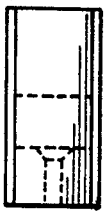
Figure 1E:
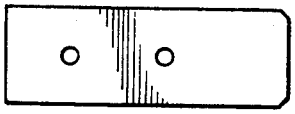

The device can also guide the toilet seat by utilizing a tapered configuration, as seen in FIG. 1C, on the restraining means to guide the toilet seat onto the toilet bowl. A further preferred embodiment includes a substantially level portion, as seen in FIG. 1C, to support the toilet seat and contact the toilet bowl while separating the toilet seat from the toilet bowl when the seat is in the lowered position and an edge portion, as seen in FIG. 1C,located between the tapered portion and the level portion, to stabilize the toilet seat by preventing lateral movement of the toilet seat when in the lowered position. In the device, the edge is substantially parallel to the inside edge of the toilet bowl when the seat is in the lowered position. This edge is preferably between 0.1 and 0.6 inches in width, especially about 0.4 inches.

Utilizing a single unit including the level portion and the tapered portion prevents any possible breakage which could occur from pressure exerted if separate guiding and level support units were utilized. Further, the level portion allows the device to completely replace the standard device utilized to separate the toilet seat from the toilet bowl. In addition, the weight placed on the level portion secures the edge portion so as to further eliminate any lateral slippage. Without this lateral slippage, the seat is safe and secure. Additionally, as a result of the stability imparted by the device, the means which connects the seat to the bowl will have much less stress and will ultimately result in a longer life of the seat connecting means and a more stable toilet seat.

The device can be made of any suitable material such as plastic, metal, graphite, wood or combinations thereof.

Figure 2:
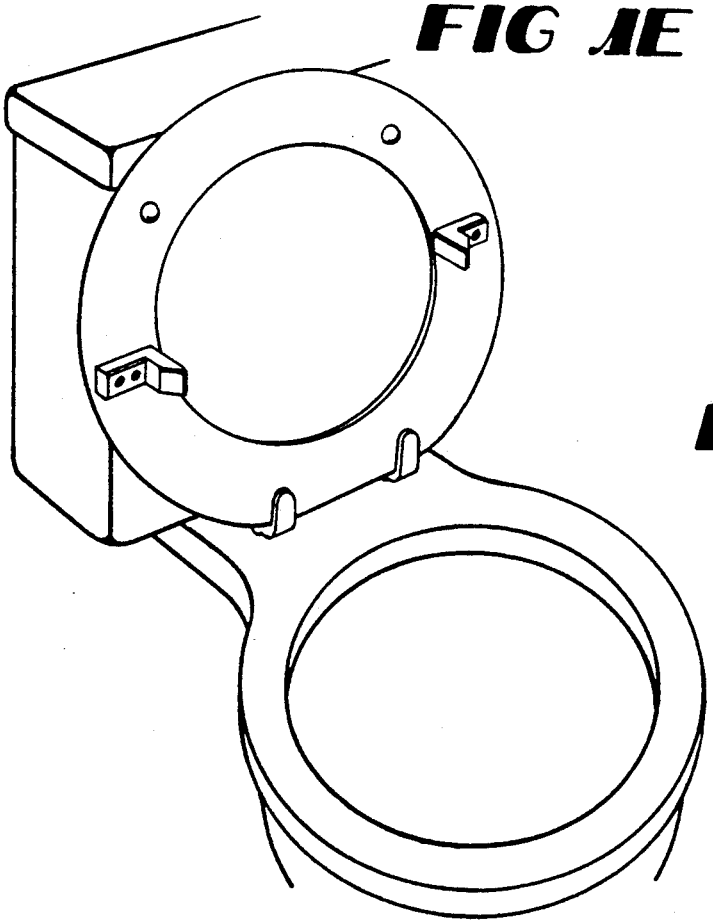
FIG. 2 shows the toilet seat guiding and stabilizing device attached in an effective manner on the toilet seat.

The device can be separately connectable to an existing toilet seat or alternatively could be a molded protrusion of the seat. The device can be connected by any suitable means such as screws, dowels, nails, glue or the like. FIG. 2 shows that at least two devices may be positioned on opposite sides of the toilet seat at a distance allowing for a secure fit to the toilet seat.

The tapered configuration can be any angle which is sufficient to guide the device onto the toilet bowl which is also sufficient to prevent lateral movement. In a preferred embodiment, the tapered configuration is at an angle of between 15 and 75 degrees to the toilet seat bottom when connected. More preferably, the tapered configuration is at an angle of between 30 and 60 degrees to the toilet seat bottom when connected, and most preferably, the tapered configuration is at about a 45 degree angle.

The length of the level portion can also be important, especially where the device replaces the device normally used to separate the toilet seat from the toilet bowl. The level portion can be as wide as the seat rim but is preferably between 0.75 and 2.25 inches, more preferably between 1.0 and 2.0 inches, and especially about 1.5 inches. Alternatively, the device of the invention can be used in conjunction with the device normally used to separate the toilet seat from the toilet bowl. In addition, the width of the substantially level portion is preferably between 0.2 and 0.6 inches and especially is about 0.4 inches.

Various other examples and modifications of the foregoing description will be apparent to a person skilled in the art without departing from the spirit and scope of the invention, and it is intended that all such examples and modifications be included within the scope of the appended claims.

What is claimed is:

1. A device for stabilizing a toilet seat in its desired position atop a toilet bowl, comprising at least one restraining means connectable to the bottom of the toilet seat for preventing lateral movement of the toilet seat relative to the toilet bowl, wherein the restraining means extends downward into the toilet bowl so as to rest immediately adjacent to an upper inside rim of the toilet bowl when the toilet seat is in its lowered position and further comprising a tapered portion on the restraining means to guide the toilet seat onto the toilet bowl, a substantially level portion connectable to the bottom of the toilet seat to support the toilet seat and to connect the toilet bowl while separating the toilet seat from the toilet bowl when the seat is in the lowered position, and an edge portion located between the tapered portion and the level portion that is substantially perpendicular to the level portion and that is substantially parallel to the inside edge of the toilet bowl when the seat is in the lowered position, to stabilize the toilet seat by preventing lateral movement.

2. The device of claim 1, further comprising a toilet seat wherein the device is connected to the toilet seat.

3. The device of claim 2, wherein at least two devices are positioned on opposite sides of the toilet seat at a distance allowing for a secure fit to the toilet seat.

4. The device of claim 1, wherein the tapered configuration is at an angle of between 15 and 75 degrees to the toilet seat bottom when connected.

5. The device of claim 1, wherein the tapered configuration is at an angle of between 30 and 60 degrees to the toilet seat bottom when connected.

6. The unit of claim 1, wherein the tapered configuration is at about a 45 degree angle.

7. The device of claim 1, wherein the level portion is between 0.75 and 2.25 inches.

8. The device of claim 1, wherein the level portion is between 1 and 2 inches.

9. The device of claim 1, wherein the level portion is 1.5 inches.

10. The device of claim 1, wherein the edge parallel to the inside edge of the toilet bowl is between 0.1 and 0.6 inches long.

11. The device of claim 1, wherein the edge parallel to the inside edge of the toilet bowl is about 0.4 inches long.

12. The device of claim 1, wherein the width of the substantially level portion is between 0.2 and 0.6 inches.

13. The device of claim 1, wherein the width of the substantially level portion is about 0.4 inches.

* * * * *